US008479633B2

(12) United States Patent
Herrmann et al.

(10) Patent No.: US 8,479,633 B2
(45) Date of Patent: Jul. 9, 2013

(54) BREECH DRIVE FOR A WEAPON WITH A LINEAR BREECH OR AMMUNITION FEED

(75) Inventors: Ralf-Joachim Herrmann, Senzig (DE); Klaus Lawitzke, Magdeburg (DE); Heiner Schmees, Celle (DE); Berthold Baumann, Eschede (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 86 days.

(21) Appl. No.: 13/153,240

(22) Filed: Jun. 3, 2011

(65) Prior Publication Data

US 2012/0132061 A1 May 31, 2012

Related U.S. Application Data

(63) Continuation-in-part of application No. PCT/EP2009/007977, filed on Nov. 7, 2009.

(30) Foreign Application Priority Data

Dec. 4, 2008 (DE) ..... 10 2008 060 214

(51) Int. Cl.
*F41A 7/08* (2006.01)
*F41A 3/00* (2006.01)

(52) U.S. Cl.
USPC ..... 89/17; 89/9

(58) Field of Classification Search
USPC ..... 89/9, 11, 12, 33.01–35.01, 17
See application file for complete search history.

(56) References Cited

U.S. PATENT DOCUMENTS

| | | | | |
|---|---|---|---|---|
| 430,206 | A | 6/1890 | Garland | |
| 475,276 | A | 5/1892 | Garland | |
| 1,424,751 | A * | 8/1922 | Bangerter | 89/126 |
| 2,378,191 | A | 6/1945 | Corte | |
| 2,604,820 | A * | 7/1952 | Schiff | 89/33.05 |
| 3,501,998 | A * | 3/1970 | Dardick | 89/156 |

(Continued)

FOREIGN PATENT DOCUMENTS

| | | | |
|---|---|---|---|
| CH | 675 767 | A5 | 10/1990 |
| DE | 70 863 | C | 9/1893 |

(Continued)

OTHER PUBLICATIONS

Notice of Allowance mailed Dec. 26, 2012 in co-pending U.S. Appl. No. 13/154,170.

(Continued)

*Primary Examiner* — Michael David
(74) *Attorney, Agent, or Firm* — Griffin & Szipl, P.C.

(57) ABSTRACT

A mechanism or drive (100) for a weapon is described, which is characterized by only a limited acceleration of the breech (20) and a jerk- and recoil-free operation, thereby reducing the inertia force and the required power and increasing the repetition rate. The reduction of the required power also results in a reduction of braking power in the case of a quick stop. For this purpose, the rotational motion of preferably a motor (50) or the like is converted to a forward or reverse motion of the breech (20) using the Scotch yoke principle. In order to allow rest periods of the breech in the end limit positions, the rod (3) and the yoke (1) are arranged radially and displaceable relative to each other so that the yoke radius changes when the yoke (1) is rotated. A control cam (6) radially guides the rod (3).

16 Claims, 3 Drawing Sheets

U.S. PATENT DOCUMENTS

| | | | | |
|---|---|---|---|---|
| 3,503,300 | A | 3/1970 | Dardick | |
| 3,648,561 | A | 3/1972 | Stoner | |
| 3,834,272 | A | 9/1974 | Patenaude et al. | |
| 4,154,142 | A | 5/1979 | Schwegler | |
| 4,301,709 | A | 11/1981 | Bohorquez et al. | |
| 4,481,858 | A | 11/1984 | Price | |
| 4,563,936 | A | 1/1986 | Cleary et al. | |
| 4,686,886 | A | 8/1987 | Caserza et al. | |
| 5,134,922 | A | 8/1992 | Menges et al. | |
| 5,353,678 | A | 10/1994 | Rochelle et al. | |
| 6,009,791 | A | 1/2000 | Medlin | |
| 2011/0290103 | A1 | 12/2011 | Herrmann et al. | |
| 2011/0314996 | A1 | 12/2011 | Herrmann | |
| 2012/0132062 | A1* | 5/2012 | Herrmann et al. | 89/17 |

FOREIGN PATENT DOCUMENTS

| | | | |
|---|---|---|---|
| DE | 30 21 200 | | 12/1980 |
| DE | 32 16 813 | A1 | 11/1983 |
| DE | 32 18550 | A1 | 11/1983 |
| DE | 37 12 905 | A1 | 11/1988 |
| DE | 36 27 361 | C1 | 4/1992 |
| DE | 10 2005 045 824 | B3 | 4/2007 |
| DE | 10 2006 022 622 | A1 | 11/2007 |
| DE | 10 2007 048 468 | A1 | 4/2009 |
| DE | 10 2007 048 470 | A1 | 4/2009 |
| DE | 10 2007 054470 | A1 | 5/2009 |
| EP | 1767891 | A1 | 3/2007 |
| FR | 538 190 | A | 6/1922 |
| GB | 577 338 | | 5/1946 |
| JP | 6-159991 | | 6/1994 |
| JP | 7-139896 | A | 6/1995 |
| JP | 7-174491 | A | 7/1995 |
| WO | 2009/049723 | A1 | 4/2009 |
| WO | 2009/062585 | A1 | 5/2009 |

OTHER PUBLICATIONS

International Search Report issued in corresponding International Application No. PCT/EP2009/007977, completed Jan. 29, 2010, mailed Feb. 10, 2010.

http://en.wikipedia.org/wiki/M242_Bushmaster, M242 Bushmaster—Wikipedia, the free encyclopedia, downloaded May 9, 2011, pp. 1-7.

International Search Report issued in co-pending International Application No. PCT/EP2009/007976, completed Jan. 29, 2010, mailed Feb. 9, 2010.

Notice of Allowance issued in co-pending U.S. Appl. No. 13/154,108, on Nov. 19, 2012.

International Search Report issued in International Application No. PCT/EP2009/07975, completed Jan. 29, 2010 and mailed Feb. 10, 2010.

International Search Report issued in International Application No. PCT/EP2009/07974, completed Jan. 29, 2010 and mailed Feb. 10, 2010.

http://www.knightswoodsecondary.org.uk/personal/Resources/Hillhead/Credit_Worksheets/CompositeAreas.pdf; downloaded May 29, 2011.

Office Action issued in co-pending related application U.S. Appl. No. 13/154,235 on Mar. 4, 2013.

* cited by examiner

BREECH DRIVE FOR A WEAPON WITH A LINEAR BREECH OR AMMUNITION FEED

This is a Continuation-in-Part Application in the United States of International Patent Application No. PCT/EP2009/007977 filed Nov. 7, 2009, which claims priority on German Patent Application No. DE 10 2008 060 214.0, filed Dec. 4, 2008. The entire disclosures of the above patent applications are hereby incorporated by reference.

FIELD OF THE INVENTION

The invention relates to drive kinematics with a thrust crank for a feed, in particular a linear feed, of a breech or of a cartridge into a weapon barrel.

BACKGROUND OF THE INVENTION

In externally powered machine guns, the energy for driving the weapon is not obtained from gas pressure or from weapon recoil, but is provided by an electrical or hydraulic drive. Particularly in the case of electrically driven weapons, the rotary movement of the motor must, for this purpose, be converted to an oscillating movement of the breech. Furthermore, the breech requires times for which it is stationary at the limit positions of its displacement movement. In a first limit position, the case of the previous round must be removed in front of the breech, and a new cartridge must be fed in front of the breech before the cartridge is driven into the cartridge chamber of the weapon barrel. In a further limit position, the breech must be locked and the cartridge fired. Once the gas pressure in the weapon barrel has fallen, the breech can then be unlocked.

A rigidly locked linear breech for an externally driven machine gun has been published in DE 36 27 361 C1. A control roll is also proposed here, for space-saving locking, without bouncing.

DE 37 12 905 A1 describes a machine gun which, inter alia, has a cam drum that is operated by an external drive and is used for linear movement of a linear breech. The cam drum correspondingly has a control cam, which runs endlessly over the circumference. Furthermore, a short radially acting control cam and a longer axially acting control cam are arranged on the circumference.

DE 10 2005 045 824 A1 proposes a physically small weapon whose control roll is integrated on the plane of the barrel bore axis. The control roll has a control body to which at least two control cams are fitted. In this case, the cam information is converted to a linear feed of the breech.

From DE 10 2007 048 468.4, which was not published prior to the priority date of this application, a drive is preferred for linear feeding of a breech, or of the ammunition into a weapon barrel, or a cartridge camber by means of a chain. In contrast to the bushmaster drive, in which a chain is passed over four sprocket wheels, in the form of a rectangle, and by means of which the stationary times of the breech are defined, the chain is, in this case, itself passed tightly around two sprocket wheels in a simple manner. A chain link or a stud on the chain is integrated in a guide or groove that is located under the movable slide. This allows the chain to continue to run during the times when the weapon is stationary, which are defined by a separate function control means. The chain itself can be driven by an electric motor. A rapid stopping means is, in this case, integrated in the path of the chain.

A linear feed of a breech with respect to the weapon barrel or cartridge chamber is described in DE 10 2007 054 470.9, which was not published prior to the priority date of this application. In this case, a linear guide groove is integrated in the drive kinematics. A means, which is physically connected to the breech, is guided in the guide groove. The guide groove is itself surrounded by a circumferential positive guide (slotted link), which itself interprets the necessary times for the breech to be stationary during locking, firing and unlocking in its front position and during loading, once the breech has been moved to its rear position. A further means is guided within the positive guide, as drive means for the breech. The drive transmission can be provided by sliding rollers, gear wheels, or the like, which are driven by a motor, etc. The drive itself continues to run during the times in which the weapon is stationary, while the breech is moved out and back in again later during the stationary times.

Although the three last-mentioned solutions themselves already deal with practicable drives, which produce satisfactory results in terms of firing rate and mechanical wear, the invention is based on the object of specifying a further drive for a breech, such as this, which is likewise also used for higher firing rates.

SUMMARY OF THE INVENTION

The invention is achieved by the features of a first embodiment directed to a drive (100) for a breech (20), which can be moved in the axial direction with respect to a weapon barrel (22), wherein the drive (100) has a motor (50) or the like, and the drive (100) has the following features: (a) a crank (1) that is driven via its rotation shaft (M), (b) a connecting rod (3) that is arranged such that a rear end ($E_h$) can be moved in a groove (1.1) in the crank (1) and is connected to a front end ($E_v$) on the breech (20) or a driver (4) of the breech (20) via a pinion (9) , wherein the crank (1) and the connecting rod (3) are connected to one another via a shaft (11) that is integrated in the groove (1.1), (c) at least one sliding means (5) that is arranged at the rear end ($E_h$) of the connecting rod (3) and that runs, guided in a control cam (6), along the control cam (6), wherein the control cam (6) is an intrinsically closed cam structure and has defined areas ($\alpha_1$, $\alpha_2$, $\alpha_3$, $\alpha_4$) as a movement profile for the breech (20), wherein the driver (4) of the breech (20), or a part of the breech (20), has a tooth system that engages in the pinion (9) that is integrated at the front such that it can rotate on/in the connecting rod (3), as a result of which the breech (20) is moved via the connecting rod (3) during rotation of the crank (1). Advantageous additional embodiments are specified as follows.

In accordance with a second embodiment of the invention, the first embodiment is modified so that the control cam (6) is integrated in the housing lower part (12) of a crank housing. In accordance with a third embodiment of the invention, the second embodiment is further modified so that the control cam (6) is a groove which is open at the bottom. In accordance with a fourth embodiment of the present invention, the first embodiment, the second embodiment, and the third embodiment are further modified so that a further control cam (6) is integrated in the housing upper part (13) and is identical to that in the housing lower part (12), but in mirror-image form.

In accordance with a fifth embodiment of the present invention, the first embodiment, the second embodiment, the third embodiment, and the fourth embodiment are further modified so that the control cams (6) are defined by four different sectors or areas, by means of which the desired movement of the feed for the breech (20) is produced. In accordance with a sixth embodiment of the present invention, the fifth embodiment is further modified so that the control cams (6) have a (thick) bean shape. In accordance with a seventh embodiment of the present invention, the first embodiment, the second embodiment, the third embodiment, the fourth embodiment, the fifth embodiment, and the sixth embodiment, are further modified so that a pair of, for example, eccentric gear wheels are located between the center shaft (M) and the motor (50) and rotate at twice the rotation speed of the crank (1). In accordance with an eighth embodiment of the present invention, the first embodiment, the second embodiment, the third embodiment, the fourth embodiment, the fifth embodiment, the sixth embodiment, and the seventh embodiment, are further modified so that the breech (20) is coupled directly to the front end of the connecting rod (3), with the driver (4) being connected in an interlocking manner to the breech (20) via the driver tabs (4.1), and with the breech (20) being moved parallel to the axis, but at least in the direction of the weapon barrel axis of the weapon barrel (22).

The invention is based on the idea of providing a mechanism that has a low-level of breech acceleration and operates smoothly and without jerking, thus decreasing the mass forces, reducing the drive power and allowing the firing rate to be increased. The reduction in the drive power furthermore results in a reduction in the braking power when rapid stopping is required.

For this purpose, the principle of a crank drive is used to convert the rotary movement, preferably of a motor or the like, to a forward and backward movement of the breech. In order to allow the breech to be stationary for times in the limit positions, a connecting rod and crank are arranged such that they can be moved radially with respect to one another, such that the crank radius changes with the rotation of the crank. The connecting rod is guided radially by a control cam.

The crank drive has the advantage that low rotating masses (e.g., crank, motor and possibly step-up transmissions) are provided, which have to be braked in the event of rapid stopping. It has also been found to be a simple design.

BRIEF DESCRIPTION OF THE DRAWINGS

The invention will be explained in more detail using one exemplary embodiment and with reference to the drawings, in which.

DETAILED DESCRIPTION OF THE INVENTION

Figure 1:
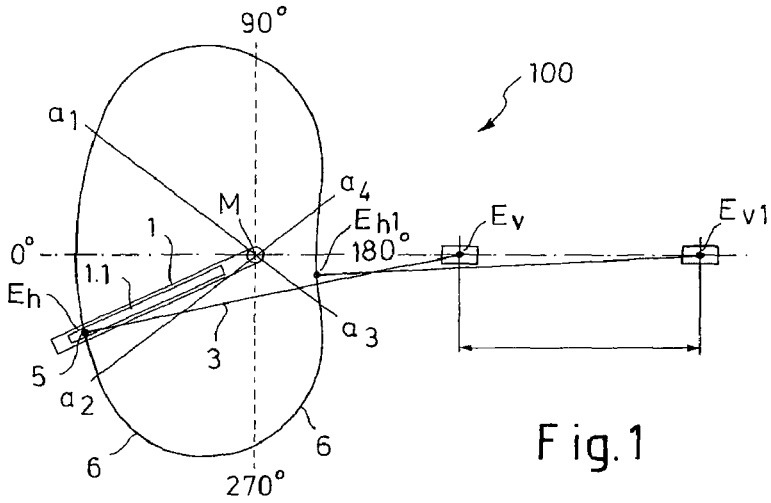
FIG. 1 shows a schematic view of a drive, according to the present invention, with a preferred control cam.

FIG. 1 shows a first general illustration of a schematically illustrated drive 100, in accordance with the present invention. A rotation shaft M of a crank 1, and therefore the crank 1 itself, are driven via a motor or the like (not illustrated in any more detail in FIG. 1). A connecting rod 3 is arranged with the rear end $E_h$ such that the rear end $E_h$ can move in a groove 1.1 in the crank 1, and the connecting rod 3 is connected to the front end $E_v$ on the breech 20 or to a driver 4 of the breech 20. Furthermore, sliding means, such as rollers 5, are arranged at the rear end $E_h$ of the connecting rod 3 and run in a control cam 6, which has a (thick) bean shape in a plan view. The control cam 6 is defined by four different sectors or areas, as shown in FIG. 1, which produce the desired movement for feeding the breech 20.

The areas of the control cam 6 define the movement processes of the breech 20 as follows:

$\alpha_1$-$\alpha_2$ first area, corresponds to the breech 20 positioned to the rear, characterized by a constant radius around the rear limit position;

$\alpha_2$-$\alpha_3$ second area, defines forward movement of the breech 20 in accordance with any desired function;

$\alpha_3$-$\alpha_4$ third area, corresponds to the breech 20 positioned to the front, characterized by a constant radius around the front limit position, $\alpha_4$-$\alpha_1$ fourth area, defines rearward movement of the breech 20 in accordance with any desired function.

In order to ensure that the breech 20 remains stationary in its limit positions (i.e., rear limit position and front limit position) for a specific time period while the crank 1 is rotated all the time, the control cam 6 has a constant radius in the areas $\alpha_1$ to $\alpha_2$ and $\alpha_3$ and $\alpha_4$ around the front and rear limit positions of the breech 20, with the length of the connecting rod 3. The shapes of the areas between $\alpha_2$ to $\alpha_3$ and $\alpha_4$ and $\alpha_1$ are predetermined by the movement functions (for example, sinusoidal profiles), that is to say they are defined by the breech movement. These can be optimized, in particular with respect to acceleration, maximum speed, smoothness and freedom from jerking, etc.

The distance that the connecting rod 3 travels between the rear limit position $E_v$ and the front limit position $E_{v1}$ corresponds to the displacement movement of the breech 20 (i.e., displacement movement of breech 20 equals front limit position $E_{v1}$ minus rear limit position $E_v$). The length of the connecting rod 3, as well as that of the crank 1 and the crank groove 1.1, are appropriately matched thereto and designed for this purpose.

Figure 2:
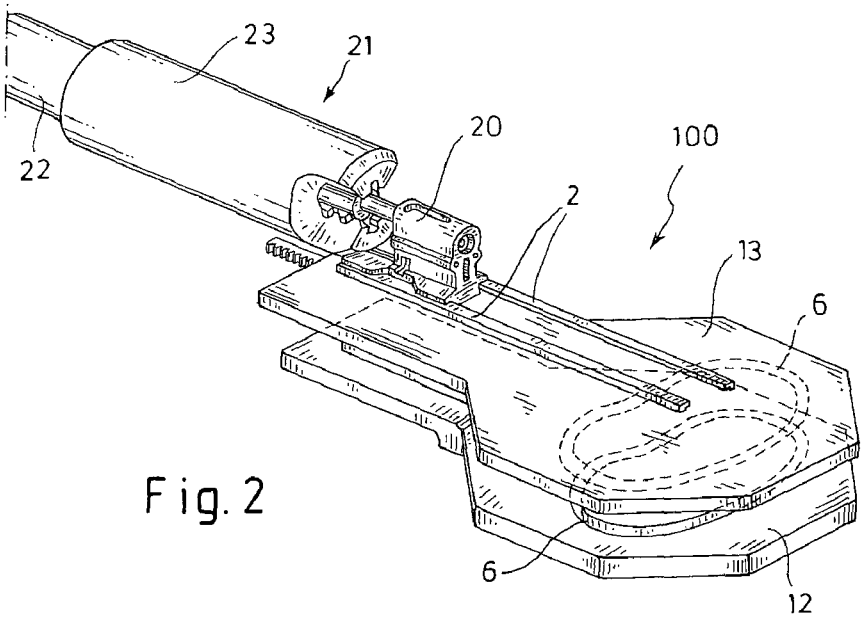
FIG. 2 shows a perspective view of a breech drive, in accordance with the present invention, for implementing the movement sequences illustrated in FIG. 1.

FIG. 2 shows a schematic illustration of the drive 100 for the breech 20 of, in particular, an externally driven weapon 21 (illustrated only partially). A weapon barrel 22 of the weapon 21 is mounted in a barrel locking bush 23, or is attached to the weapon housing. The breech 20 can be locked thereto. The breech 20 can be moved on breech guides 2 in the direction of the weapon barrel axis. A crank housing is also shown, and integration in a weapon housing is also possible, with a housing lower part 12 and, in the preferred embodiment, with a housing upper part 13. The control cams 6 are integrated therein, in each case in mirror-image form. The housing upper part 13 can be dispensed with (i.e., omitted) if the shaft 11 can be prevented from jamming in only one control cam 6. The control cam 6 can then be passed through the housing lower part 12 via a groove which is open at the bottom.

Figure 3:
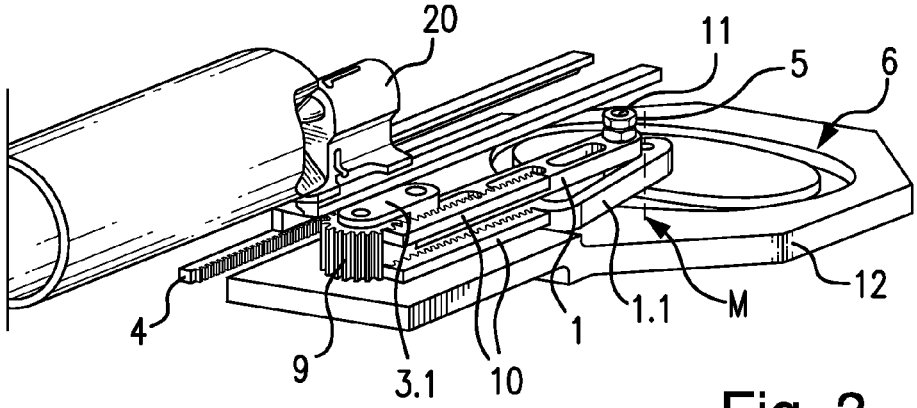
FIG. 3 shows another perspective detail view from FIG. 2.
Figure 4:
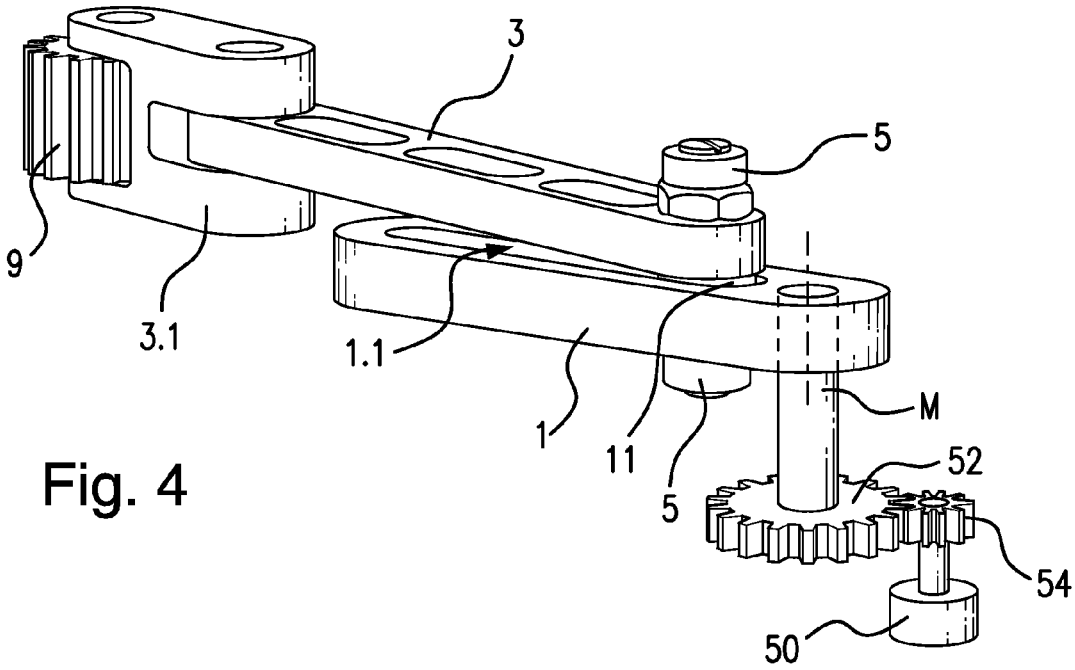
FIG. 4 shows a partial view from FIG. 3.
Figure 5:
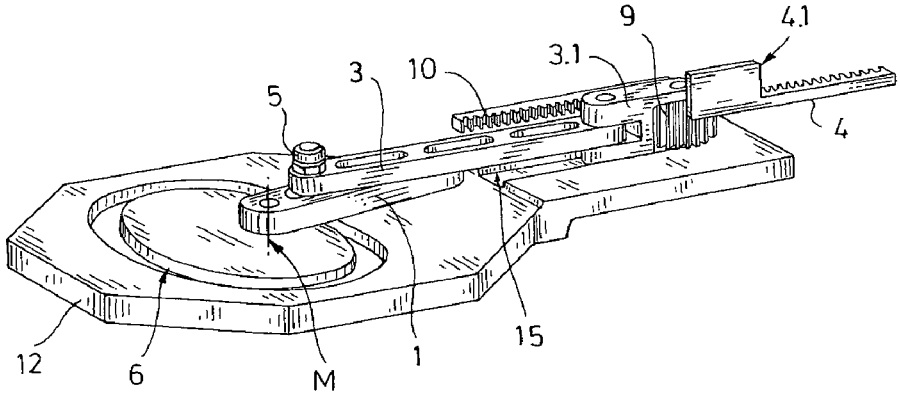
FIG. 5 shows another partial view from FIG. 3.

FIG. 3, in conjunction with FIG. 5, shows the breech driver 4, whose driver tab 4.1 is connected in an interlocking manner to the breech 20, and whose tooth system engages with that on a pinion 9. On the opposite side, the pinion 9 engages with toothed rods that are fixed to the housing (this attachment is not itself illustrated in any more detail), and is mounted such that it can rotate on the connecting rod head 3.1, which is in turn connected via a bolt to the connecting rod 3. The connecting rod 3 and the crank 1 are connected by means of a shaft 11, with the rollers 5, which are mounted on both ends of the shaft 11 such that they can rotate, running in the control cams 6 in the housing lower part 12 and housing upper part 13 and in which case the shaft 11 can be moved in the groove 1.1 in the crank 1. The crank 1 is mounted on the housing lower part 12 such that it can rotate about the center shaft M, with the crank 1 being driven by the motor 50 via the center shaft M (See FIG. 4).

In order to produce the desired oscillating movement of the breech 20 with waiting times in the reversal positions, the crank 1 is caused to rotate continuously about the center shaft M by the motor 50. In this case, the crank 1 drives the shaft 11 in the same rotation direction. The shaft is radially guided by the preferably two identical control cams 6 in the housing lower part 12 and the housing upper part 13 in which lower and upper rollers 5 on the shaft 11 are guided. The shaft 11 transmits its movement, corresponding to the shape of the control cam 6, by means of the connecting rod 3 to the connecting rod head 3.1 (See FIG. 4).

As can be seen from FIG. 5, the connecting rod head 3.1 is guided in grooves 15 in the housing lower part and the housing upper part 13 (this is not illustrated in any more detail, i.e., the housing upper part 13 is omitted from FIG. 5 so that the placement of the lower surface of connecting rod head 3.1 in the groove 15 of the housing lower part 12 may be appreciated; however, the upper surface connecting rod head 3.1 is correspondingly guided in a groove 15 in the housing upper part 13), where the lateral forces are absorbed. The pinion 9 on the connecting rod head 3.1 rolls on the tooth rods 10, which are fixed to the housing, during movement, and is rotated. The rotary movement of the pinion 9 drives the driver 4, thus doubling the linear movement in comparison to that of the connecting rod head 3.1. If such a long linear movement is not required, the breech 20 can alternatively also be coupled directly to the front end of the connecting rod 3. Since the driver 4 is connected in an interlocking manner to the breech 20 via the driver tabs 4.1, the breech 20 is moved parallel to the axis, but at least in the direction of the weapon barrel axis of the weapon barrel 22, by the driver 4.

An even more compact physical form for the control cam or cams 6 can be achieved by arranging a pair of, for example eccentric, gearwheels 52, 54 (not illustrated in any more detail than schematically in FIG. 4) between the center shaft M and the motor 50, and these gear wheels 52, 54 rotate at twice the rotation speed of the crank 1. Eccentric gearwheels 52, 54 result in a continuous step-up ratio, as a result of which, when the motor rotation speed is constant, the crank 1 rotates more slowly during the waiting time phases, and more quickly during the breech movement phases. The angle ranges $\alpha_1$ to $\alpha_2$ and $\alpha_3$ and $\alpha_4$ of the control cam or cams 6 can therefore be made smaller, without shortening the waiting times of the breech 20 in the front and rear limit positions.

The invention claimed is:

1. A drive operably connected to a breech so that the breech is moveable in an axial direction with respect to a weapon barrel of a weapon, wherein the drive comprises:

(a) a crank driven via a rotation shaft connected to a motor;

(b) a connecting rod arranged so that a rear end of the connecting rod is moveable in a groove formed in the crank, and a front end of the connecting rod is connected to the breech, or to a driver of the breech, via a pinion, wherein the crank and the connecting rod are connected to one another via a shaft that integrated in the groove;

(c) at least one sliding means arranged at the rear end of the connecting rod, wherein the at least one sliding means runs, guided by a first control cam, along the first control cam, wherein the first control cam is an intrinsically closed cam structure and has a plurality of defined areas defining a movement profile for the breech, wherein the driver of the breech or a part of the breech, has a tooth system that engages the pinion, wherein the pinion is integrated at a front of the connecting rod so as to rotate on the connecting rod and, as a result of rotation of the pinion, the breech is moved via the connecting rod during rotation of the crank.

2. The drive as claimed in claim 1, wherein the first control cam is integrated in a housing lower part of a crank housing.

3. The drive as claimed in claim 2, wherein the first control cam includes a groove that is open at a bottom.

4. The drive as claimed in claim 3, further comprising:

(d) a second control cam integrated in a housing upper part that is identical to the housing lower part except that the housing upper part is in mirror-image form to the housing lower part.

5. The drive as claimed in claim 3, wherein the first control cam has four different areas defining the movement profile of a feed of the breech.

6. The drive as claimed in claim 5, wherein the first control cam has a thick bean shape.

7. The drive as claimed in claim 2, further comprising:

(d) a second control cam integrated in a housing upper part that is identical to the housing lower part except that the housing upper part is in mirror-image form to the housing lower part.

8. The drive as claimed in claim 2, wherein the first control cam has four different areas defining the movement profile of a feed of the breech.

9. The drive as claimed in claim 8, wherein the first control cam has a thick bean shape.

10. The drive as claimed in claim 1, further comprising:

(d) a second control cam integrated in a housing upper part that is identical to a housing lower part except that the housing upper part is in mirror-image form to the housing lower part.

11. The drive as claimed in claim 10, wherein the first control cam and the second control cam each have four different areas defining the movement profile of a feed of the breech.

12. The drive as claimed in claim 11, wherein each of the first control cam and the second control cam has a thick bean shape.

13. The drive as claimed in claim 1, wherein the first control cam has four different areas defining movement profile of a feed of the breech.

14. The drive as claimed in claim 13, wherein the first control cam has a thick bean shape.

15. The drive as claimed in claim 1, wherein a pair of eccentric gear wheels are located between the rotation shaft and the motor and rotate at twice the rotation speed of the crank.

16. The drive as claimed in claim 1, wherein the breech is coupled directly to the front end of the connecting rod, wherein the driver is connected in an interlocking manner to the breech via one or more driver tabs, and wherein the breech is moved parallel to the axial direction that is at least in a direction of a weapon barrel axis of the weapon barrel.

* * * * *